US005190508A

United States Patent [19]

Kliewer et al.

[11] Patent Number: 5,190,508

[45] Date of Patent: Mar. 2, 1993

[54] RETRACTABLE JUMP ROPE

[76] Inventors: Paul E. Kliewer; Barbara A. Kliewer, both of 405 Brooks Lake Rd., Cokato, Minn. 55321

[21] Appl. No.: 845,015

[22] Filed: Mar. 3, 1992

[51] Int. Cl.[5] ..... A63B 5/20

[52] U.S. Cl. ..... 482/82

[58] Field of Search ..... 482/81, 82, 148, 121-126, 482/908

[56] References Cited

U.S. PATENT DOCUMENTS 512,483 1/1894 Patterson ..... 482/82
3,762,704 10/1973 Gingras .
4,007,931 2/1977 Wich et al. ..... 482/82
4,934,691 6/1990 Rudd ..... 482/82
4,955,601 9/1990 Ueng .
5,054,772 10/1991 Winston ..... 482/82

*Primary Examiner*—Stephen R. Crow
*Attorney, Agent, or Firm*—Palmatier, Sjoquist & Helget

[57] ABSTRACT

The jump rope which is disclosed includes a spiral cord which is extendable from a relatively short to a relatively long length by centrifugal force when swung. In its short form, the spiral cord is stored in tubular handles affixed to ends of the cord and fixable to each other. The handles are disconnectable from each other to release the spiral cord, and are manipulated to swing the cord to extend the cord for jumping rope.

15 Claims, 2 Drawing Sheets

RETRACTABLE JUMP ROPE

The present invention relates to jump ropes and, more particularly, to retractable jump ropes.

BACKGROUND OF THE INVENTION

By its very nature, a jump rope is difficult to store. Even if bundled with care, the jump rope may become knotted or entangled, or may hook or ensnare other proximate objects. These problems are compounded when jump ropes are stored together such as in boxes for physical education or aerobic classes. When so stored, the jump ropes resemble spaghetti, and it is often difficult to separate the jump ropes.

SUMMARY OF THE INVENTION

A feature of the present invention is the provision in a jump rope having a pair of handles, of a cord extending between the handles and being extendable in length by centrifugal force being exerted on the cord when the handles are manipulated to swing the cord for jumping rope.

Another feature is the provision in a jump rope having a pair of handles, of the handles being tubular for storing the cord of the jump rope and being connectable together to form a one-piece storage unit for the jump rope.

Another feature is the provision in such a jump rope, of the cord of the jump rope being spiral.

Another feature is the provision in such a jump rope, of the cord for the jump rope being a telephone cord.

Another feature is the provision in such a jump rope, of the spiral cord being resiliently retractable into a shortened form.

Another feature is the provision in such a jump rope, of spin means between each of the handles and the cord for permitting an axial spinning of the cord relative to the handles.

An advantage of the present invention is neatness. A great number of jump ropes may be stored together without a tangling of the jump ropes.

Another advantage is compactness. The present jump rope occupies a minimum amount of space when stored in the tubular handles.

Another advantage is that, even when out of its respective tubular handles, the present jump rope occupies a minimum amount of space. Between jumping exercises, when at rest, the spiral cord of the jump rope resiliently retracts to a relatively short length. Accordingly, accidents such as tripping over the jump rope may be minimal. The jump rope extends to its longer length only when being swung.

Another advantage is that the present jump rope is easily transported. The handles when fixed together act as a carrying case.

Another advantage is that the present jump rope may be utilized for other purposes. For example, in its connected one-piece form, the jump rope may be used as a baton for a relay race. Alternately, in its disconnected two-piece form, the handles may be hit together like lummi sticks to establish rhythm for a dance.

DETAILED DESCRIPTION OF THE PREFERRED EMBODIMENTS

Figure 1:
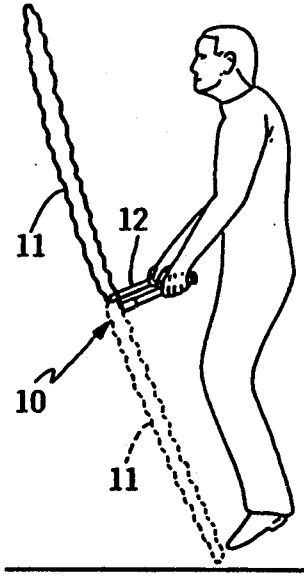
FIG. 1 is an environmental view of the present retractable jump rope in use.
Figure 2:
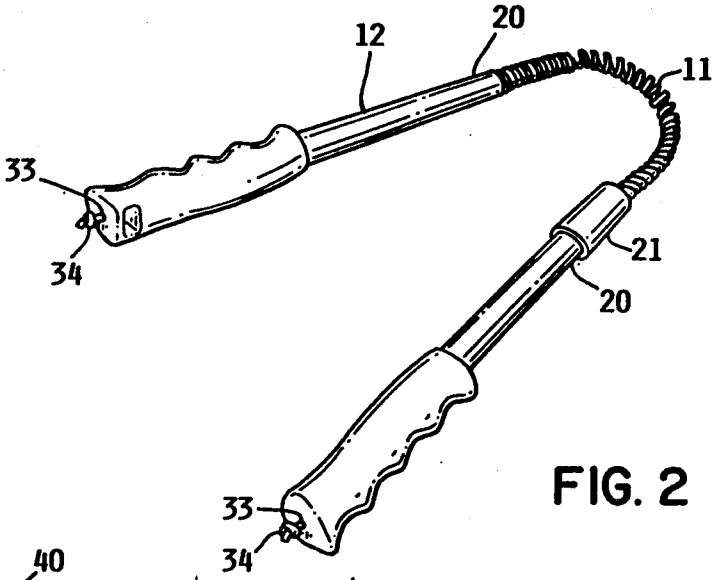
FIG. 2 is a detail perspective of the jump rope of FIG. 1 with the handles disconnected from each other.
Figure 3A:
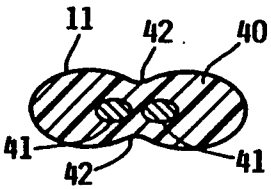
FIG. 3A is a section view of the cord of the jump rope of FIG. 1.
Figure 3:
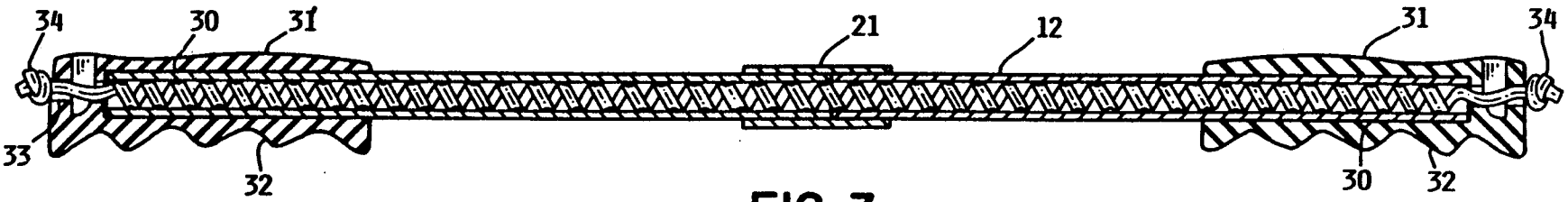
FIG. 3 is a section view of the jump rope of FIG. 1 with the handles connected to each other.

As shown in FIG. 1, the present jump rope is indicated in general by the reference numeral 10. The jump rope 10 includes an extendable cord 11 fixed between handles 12. The cord 11 is extended by centrifugal force being exerted on the cord 11 when the handles 12 are manipulated to swing the cord 11 for the sport of jumping rope.

More specifically, each of the handles 12 is tubular for storing its respective cord portion. The inner diameter of each of the handles 12 is only slightly greater than the diameter of the cord 11 when the cord 11 resiliently retracts to permit the cord 11 to retract easily axially but to minimize radial movement of the cord 11 when in such retracted form.

Each of the handles 12 includes a distal end 20. One of the distal ends 20 includes a cylindrical female connector 21 for engaging the male distal end 20 of the other handle 12 such that the handles 12 are fixable frictionally to each other for storing and carrying the jump rope 10.

Each of the handles 12 further includes a proximal end 30 on which is mounted a hand grip 31. Each of the hand grips 31 includes an undulating portion 32 for receiving fingers for a secure grip. Each of the hand grips 31 further includes an axial aperture 33 through which the cord 11 extends. Ends 34 of the cord 11 are knotted to a diameter larger than the apertures 33 to secure the cord 11 relative to the handles 12 but to permit axial spinning of the cord 11 relative to the handles 12 to minimize twisting of the cord 11 the cord 11 is when swung.

The cord 11 is preferably a telephone cord. The cord 11 is spiral and at rest resiliently retracts to a relatively short length. In other words, the cord 11 is biased toward a shortened, retracted form. When the handles 12 are manipulated to swing the cord 11, the cord 11 extends to a relatively long length under centrifugal force. The cord 11 includes a plastic outer shell 40 surrounding two copper wire strands 41. The cord 11 further includes longitudinally extending shallow depressions 42 extending on either side of the plastic outer shell 40.

In operation, the jump rope 10 is manipulated by swinging the handles 12 to extend the cord 11 by centrifugal force for the sport of jumping rope. When at rest, the cord 11 resiliently retracts axially to a relatively short length. In such a shortened form, the cord 11 is stored in the tubular handles 12, which are secured to each other via the female connector 21.

Figure 4:
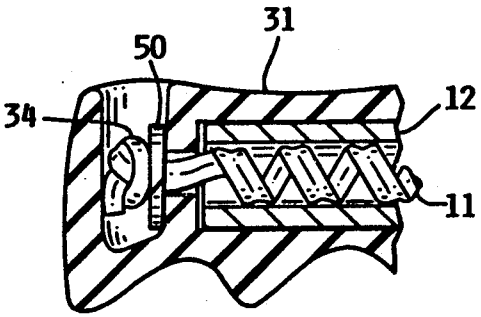
FIG. 4 is a detail section view of an alternate embodiment of the invention showing spin means for permitting an axial spinning of the cord relative to the handles.

As shown in FIG. 4, in an alternate embodiment of the invention, a washer or spin means 50 is disposed between the knotted end 34 and the hand grip 31 to more readily permit the cord 11 to spin axially relative to the handles 12 to minimize twisting of the cord 11 when swung.

Figure 5:
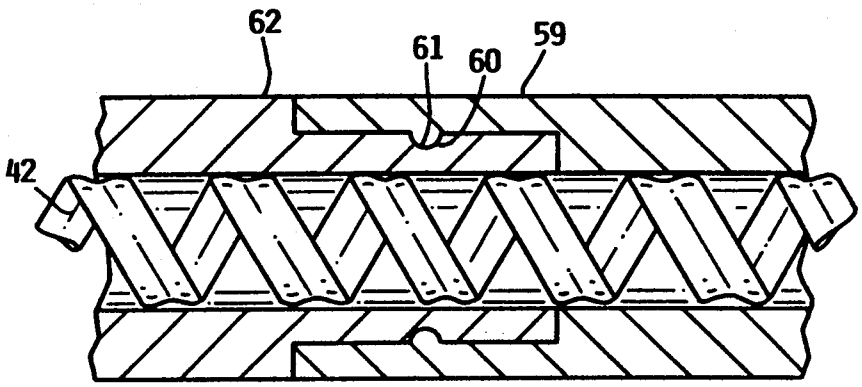
FIG. 5 is a detail section view of another alternate embodiment of the invention showing a rib and detent arrangement for connecting the handles to each other.

As shown in FIG. 5, in another alternate embodiment of the invention, a female distal end 59 of one of the handles 12 includes an inner radial annular rib 60 for engaging an outer radial annular detent 61 formed in a male distal end 62 of the other handle 12 so as to secure the handles 12 together.

Figure 6:
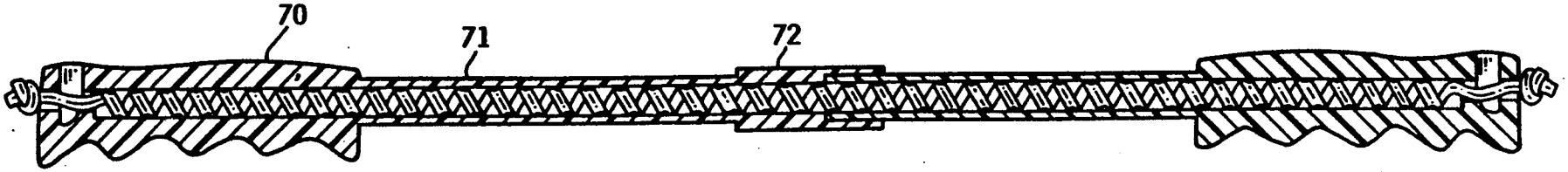
FIG. 6 is a detail section view of another alternate embodiment of the invention showing integral molded handles.

As shown in FIG. 6, in another alternate embodiment of the invention, the hand grips 70 are integrally molded with the tubular handles 71. A female connector 72 on one of the distal ends of one of the handles 71 is also integrally molded with its respective handle 71.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A jump rope comprising:

a) a pair of elongated handles; and b) a spirally coiled cord having open coils and extending between the handles and being extendable in length by centrifugal force being exerted on the cord when the handles are manipulated to swing the cord for jumping rope, the centrifugal force extending the cord to a longer length sufficient for jumping rope, the cord being resiliently retractable to a shorter length insufficient for jumping rope when the cord is at rest, wherein the handles are tubular and engageable to each other, the cord being retractable into the handles whereby the jump rope may be stored in one piece.

2. The jump rope according to claim 1, wherein the cord includes a wire extending axially at least partially therethrough.

3. The jump rope according to claim 1, wherein each of the handles include an undulating gripping portion for a secure hand grip.

4. The jump rope according to claim 3, wherein each of the grip portions is integral with its respective handle.

5. The jump rope according to claim 1, further comprising spin means between each of the handles and the cord for permitting an axial spinning of the cord relative to the handles.

6. The jump rope according to claim 5 and each of the handles having a distal end, the spin means being adjacent each of the distal ends.

7. The jump rope according to claim 1, and the handles including proximal ends, the ends being engageable to each other through a snap arrangement.

8. The jump rope according to claim 1 and the handles including proximal ends engageable to each other through a male/female arrangement.

9. A jump rope comprising:

a) a pair of tubular handles having proximal and distal ends, the distal ends being connectable to each other; and b) a spirally coiled cord having open coils and extending between the distal ends of the handles and being disposable in the handles when the handles are connected, the cord being extendable to a sufficient length by centrifugal force for the sport of jumping rope when the handles are swung, the cord being resiliently retractable to a shorter length insufficient for jumping rope when the cord is at rest.

10. A jump rope comprising:

a) a pair of elongated handles, each of the handles being tubular and having proximal and distal ends, the proximal ends being engageable to each other such that the handles may be joined to form one-piece;

b) an undulating gripping portion adjacent the distal end of each of the handles; and c) a cord having open coils and extending between the distal ends of the handles and being coiled in a spiral fashion between the distal ends, the cord being resiliently retractable to a length insufficient for jumping rope when at rest, the cord being extendable to a length sufficient for jumping rope by centrifugal force being exerted on the cord when the handles ar manipulated to swing the cord for jumping rope, said cord being retractable into the tubular handles for storage.

11. The jump rope according to claim 10, wherein the cord comprises a wire portion.

12. The jump rope according to claim 10, wherein the handles are integral with their respective gripping portion.

13. The jump rope according to claim 10, wherein the proximal ends engage each other through a snap arrangement.

14. The jump rope according to claim 10, where the proximal ends engage each other through a male/-female arrangement.

15. The jump rope according to claim 10, further comprising spin means between the distal ends and the cord for permitting axial spinning of the cord when swung.

* * * * *